US007497715B2

(12) United States Patent
Wu

(10) Patent No.: US 7,497,715 B2
(45) Date of Patent: Mar. 3, 2009

(54) CABLE CONNECTOR ASSEMBLY FOR SOLAR DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/811,826

(22) Filed: Jun. 11, 2007

(65) Prior Publication Data

US 2008/0305668 A1 Dec. 11, 2008

(51) Int. Cl.
*H01R 13/62* (2006.01)

(52) U.S. Cl. ..... 439/329

(58) Field of Classification Search ..... 439/329, 439/63, 78

See application file for complete search history.

(56) References Cited

U.S. PATENT DOCUMENTS 3,633,152 A * 1/1972 Podmore ..... 439/329
3,744,009 A * 7/1973 Teagno et al. ..... 439/329
3,915,535 A * 10/1975 O'Keefe et al. ..... 439/63
3,964,815 A * 6/1976 McDonough ..... 439/423
4,310,211 A 1/1982 Bunnell et al.
5,013,247 A * 5/1991 Watson ..... 439/55
5,015,197 A * 5/1991 Redmond et al. ..... 439/329
5,383,788 A * 1/1995 Spencer ..... 439/67
5,437,562 A * 8/1995 Michael ..... 439/581
5,482,477 A * 1/1996 Michael ..... 439/581
5,676,562 A * 10/1997 Fukuda ..... 439/329
5,711,676 A * 1/1998 Michael, III ..... 439/63
6,007,359 A * 12/1999 Kosmala ..... 439/329
6,053,743 A * 4/2000 Mitchell et al. ..... 439/63
6,099,356 A * 8/2000 Hwang ..... 439/660
6,220,881 B1 * 4/2001 Murakami et al. ..... 439/262
6,257,912 B1 * 7/2001 Boillot et al. ..... 439/329
6,781,230 B2 * 8/2004 Tsukamoto ..... 257/700
7,059,884 B2 * 6/2006 Hisaeda et al. ..... 439/329
7,144,256 B2 * 12/2006 Pabst et al. ..... 439/67
7,153,173 B2 * 12/2006 Harasawa et al. ..... 439/862
7,179,134 B2 * 2/2007 Harasawa et al. ..... 439/752
2002/0048975 A1 * 4/2002 Horikoshi et al. ..... 439/78

* cited by examiner

*Primary Examiner*—Ross N Gushi
(74) *Attorney, Agent, or Firm*—Wei Te Chung

(57) ABSTRACT

A cable connector assembly (100) includes a metallic plug member (1) connecting with a cable (3) connecting thereto, a metallic receptacle connector (2) for accommodating the plug member (1) and a printed circuit board (4) with the receptacle connector (2) mounted thereon. Said plug member (1) has a bottom side (11) and a pair transversal sides (12) respectively extending upwardly from transversal edges of the bottom side (11) to form a receiving space (111), a first terminal (13) disposed in the receiving space (111), and at least one tab (121) formed on the transversal side (12). The receptacle member (2) includes a planar top wall (21), a pair of transversal walls (22) bent downwardly from opposite side edges of the top wall (21) to form a hollow (211) receiving the plug member (1). The transversal wall (22) of the receptacle member (2) defines a locking hole (221) latching with the tab (212) of the transversal side (12) of the plug member (1).

20 Claims, 6 Drawing Sheets

CABLE CONNECTOR ASSEMBLY FOR SOLAR DEVICE

BACKGROUND OF THE INVENTION

1. Field of the Invention

The present invention generally relates to a cable connector assembly, and more particularly to a cable connector assembly used for solar device.

2. Description of Related Art

It is known to us that solar energy is a kind of recycled energy that may substitute fossil energy, such as oil, gas and coal etc. Generally, solar energy is transformed into electrical energy or other kind of second source energy via a solar device or solar system. The solar device/system usually consists of a solar panel, a solar power control system and a storage battery. The solar device has a number of solar cells which absorbs the solar energy and transform it into electrical energy. And the solar power control system comprises a printed circuit board (PCB) with a number of electrical components mounted thereon. The electrical energy of the solar cells is transmitted to the solar power control system via a cable connector assembly then, the electricity from the solar cells is transformed into electricity with different standards, such as those electricity of different voltages, currents and so on, which is adapted for charging the storage battery. However, as the cable connector assemblies of the solar device are usually exposed outdoors, a reliable connection between the solar panel and solar power control system is greatly influenced by natural environment, for example, sunshine, wind, rain. So, how to keep a desirable connection between the solar panel and the solar power control system should be taken into account by solar device manufacturers as well as cable connector assemblies' suppliers.

Hence, a cable connector assembly for solar device is highly desired to overcome the aforementioned problems.

SUMMARY OF THE INVENTION

Accordingly, an object of the present invention is to provide a cable connector assembly which can securely and reliably connect to a solar device.

In order to achieve the object set forth, an cable connector assembly in accordance with the present invention comprises a metallic plug member with a cable connecting thereto, a receptacle connector for accommodating the plug member. Said plug member comprises a bottom side and a pair transversal sides respectively extending upwardly from transversal edges of the bottom side to form a receiving space, a first terminal disposed in the receiving space, and at least one tab formed on the transversal side. The receptacle member comprises a planar top wall, a pair of transversal walls bent downwardly from opposite side edges of the top wall to form a hollow receiving the plug member. The transversal wall of the receptacle member defines a locking hole latching with the tab of the transversal side of the plug member.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
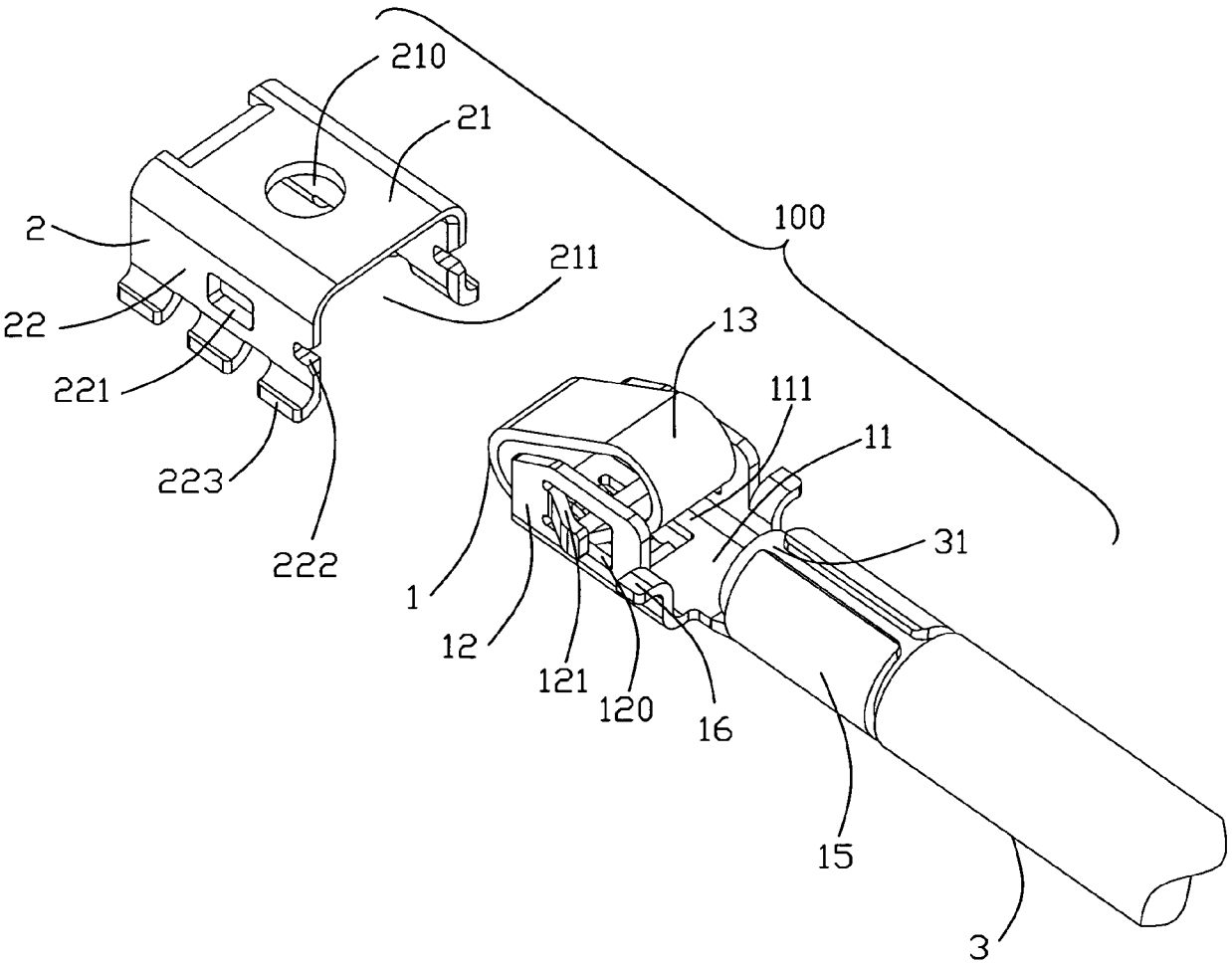
FIG. 1 shows a cable connector assembly consisting of a plug member with a cable connecting thereto, and a receptacle member for mating with the plug connector.
Figure 2:
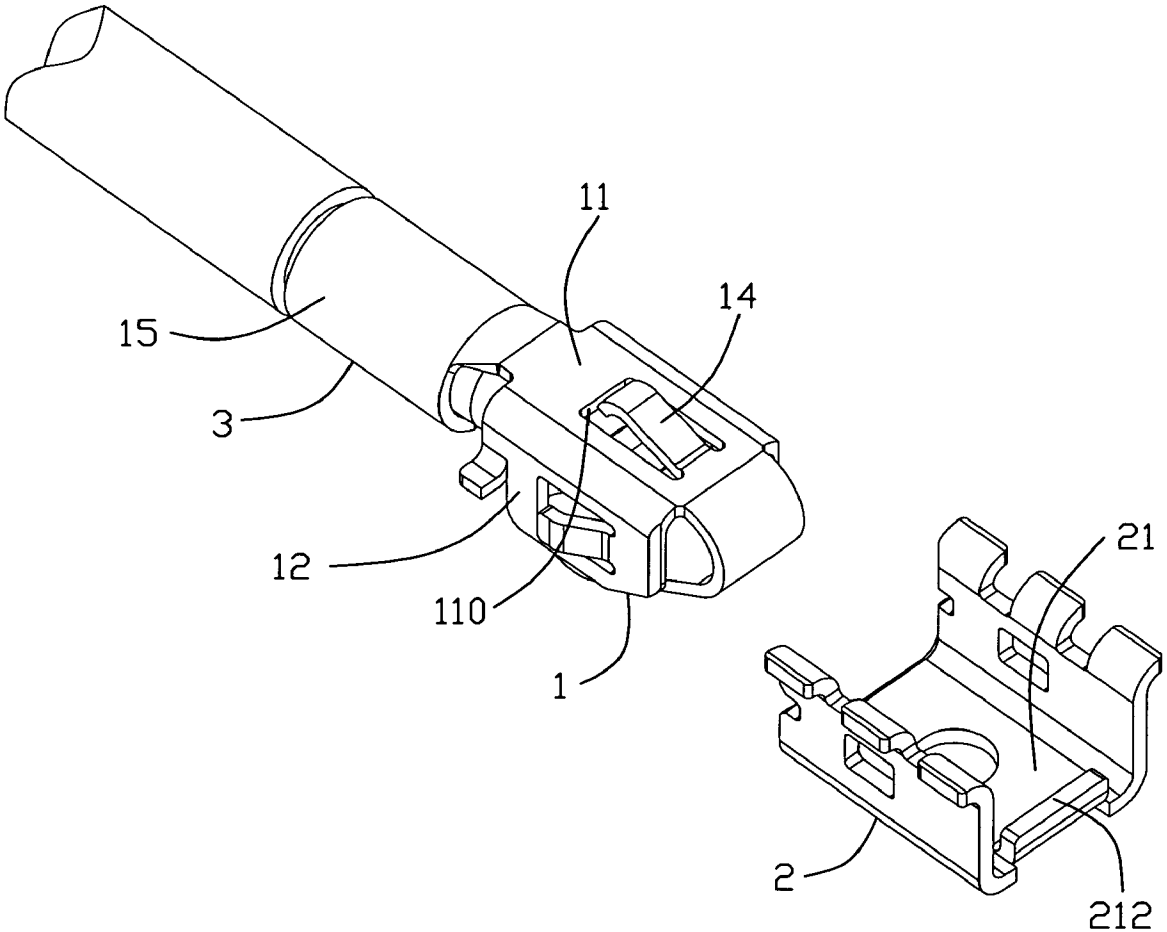
FIG. 2 is similar to FIG. 1, but viewed from another aspect.
Figure 3:
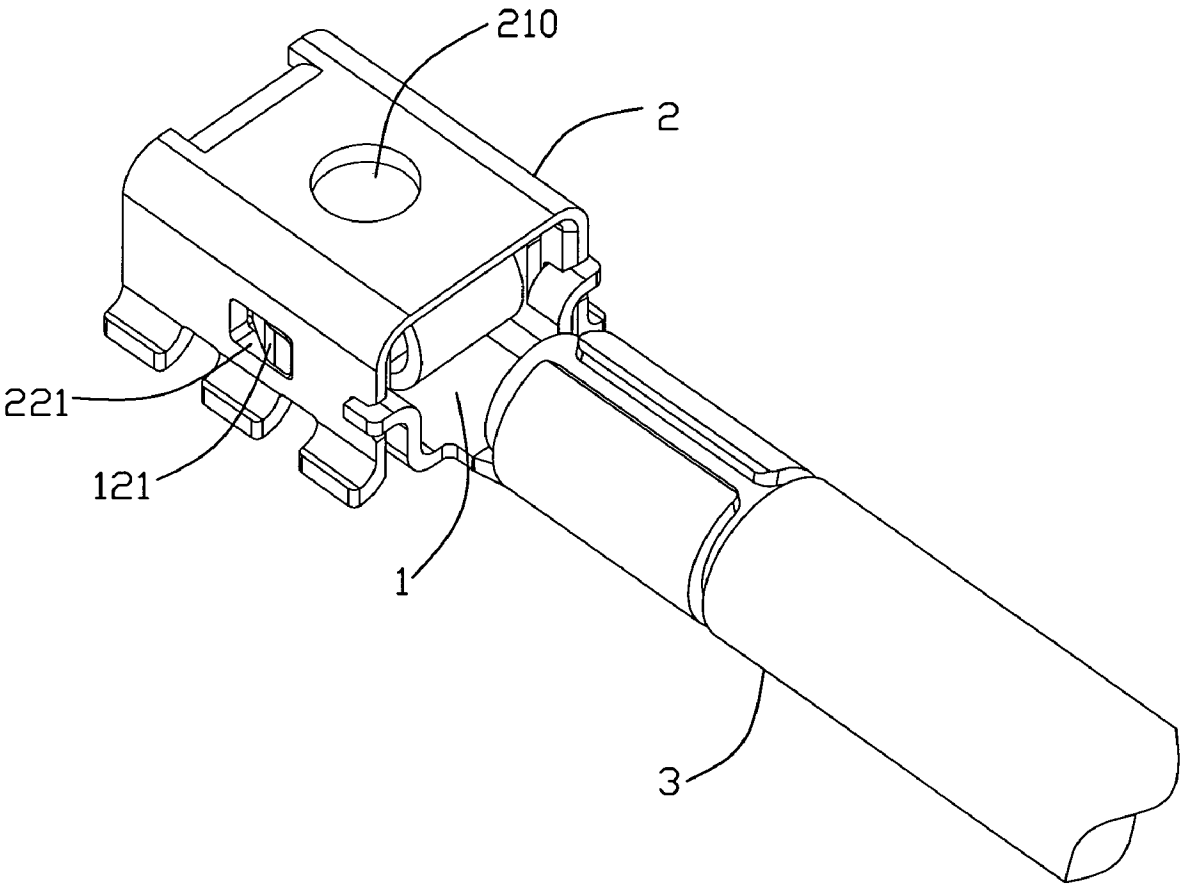
FIG. 3 shows the plug member mating with the receptacle member as shown in FIG. 1.
Figure 4:
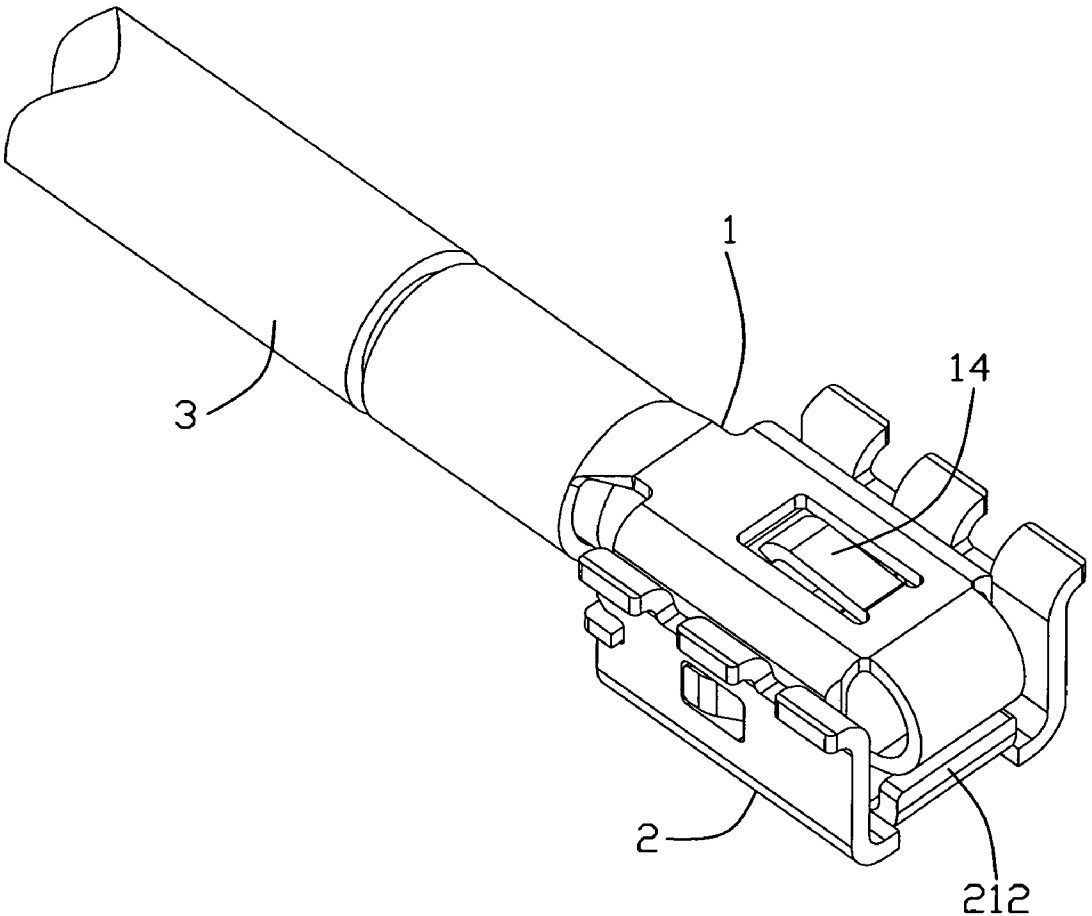
FIG. 4 is similar to FIG. 3, but viewed from another aspect.
Figure 6:
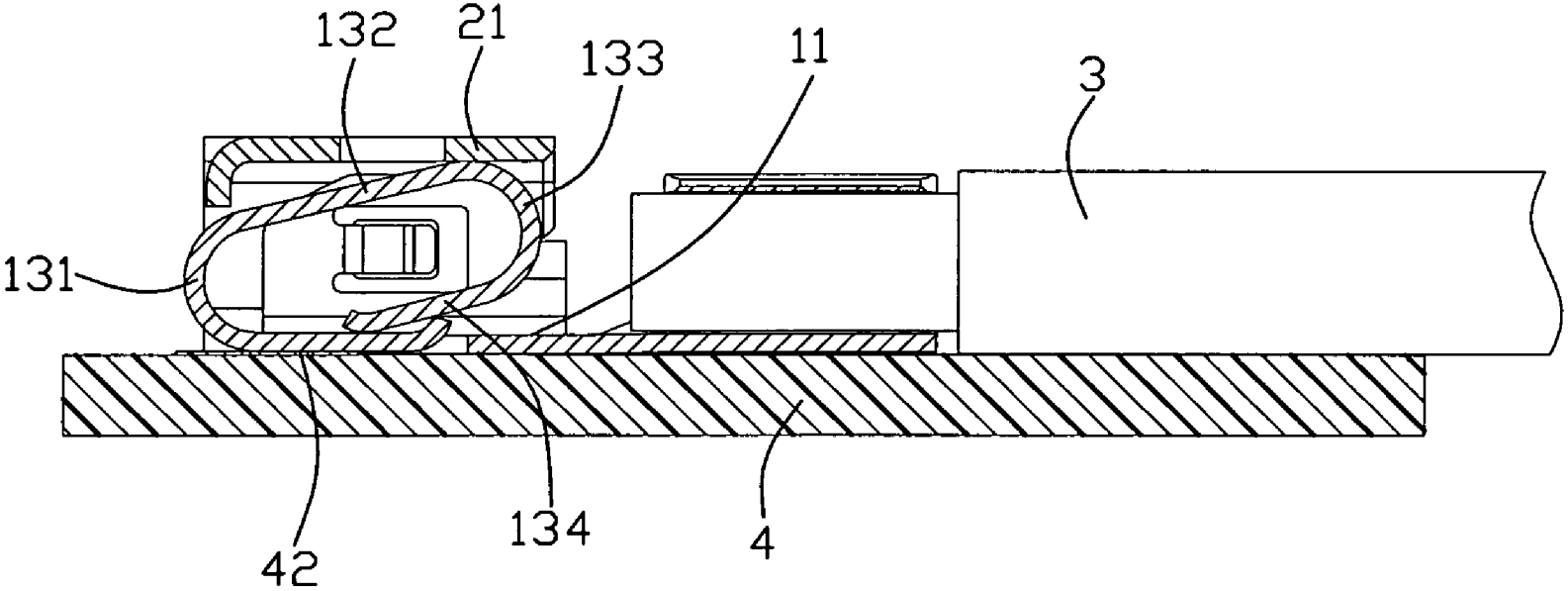
FIG. 6 is cross-section view of FIG. 5 taken along line 6-6.

Referring to FIGS. 1-2 and 6, a cable connector assembly 100 in accordance with the present invention comprises a metallic plug member 1, a metallic receptacle member 2 for receiving the plug member 1, a cable 3 connecting to the plug member 1 and a printed circuit board 4 with the receptacle member 2 mounted thereon.

The plug member 1 is stamped of a single sheet metal and comprises a planar bottom side 11 and a pair transversal sides 12 respectively extending upwardly from transversal edges of the bottom side 11 to form a receiving space 111. A first elastic terminal 13 is disposed in the receiving space 111. The terminal 13 comprises an arch-shaped supporting portion 131 extending upwardly from the front end of the bottom side 11, an inclined planar beam 132 extending upwardly and slantways from the top end of the supporting portion 131, an arch-shaped transition portion 133 bent downwardly from the top end of the planar beam 132, and a stretched free portion 134 substantially parallel to the planar beam 132 and extending downwardly and slantways from the lower end of the transition portion 133. A substantially cylindrical-shaped connection portion 15 extends rearward from a rear end of the planar bottom side 11, with an inner conductor 31 of the cable 3 crimped therein. The bottom side 11 defines a first rectangular window 110 in the middle area thereof and a second terminal 14 springs downward and rearward away from the front edge of the rectangular window 110. Each transversal side 12 has a rectangular opening 120 and an elastic tab 121 extends rearward and outward from front edge of corresponding rectangular opening 120. A pair of inverted L-shaped stubs 16 respectively lies at the two opposite rear portions of the planar bottom side 11 and are adjacent to the pair of transversal sides 12.

The receptacle member 2 is substantially of Ω-shaped and made of a single sheet metal. The receptacle member 2 comprises a planar top wall 21, a pair of transversal walls 22 bent downwardly from opposite side edges of the top wall 21 to form a hollow 211 therebetween. A middle portion of each transversal wall 22 has a rectangular locking hole 221, and a front portion of each transversal wall 22 further defines a cutout 222 mainly extending rearward from corresponding front edge thereof. Thus, the cutout 222 and the rectangular locking hole 221 are aligned with each other and spaced arranged along front-to-back direction. Three spaced apart mounting feet 223 are formed at bottom edge of each transversal wall 22. A protrusion portion 212 is bent downwardly at a rear portion of the top wall 21 and a circular hole 210 is defined on a middle portion of the top wall 21. The protrusion portion 212 may prevent the first terminal 13 from sliding out of the hollow 211 when the plug member 1 mating with the receptacle member 2. The circuit hole 210 acts as backup for soldering when the receptacle member 2 and the plug member 1 can't couple together securely.

Figure 5:
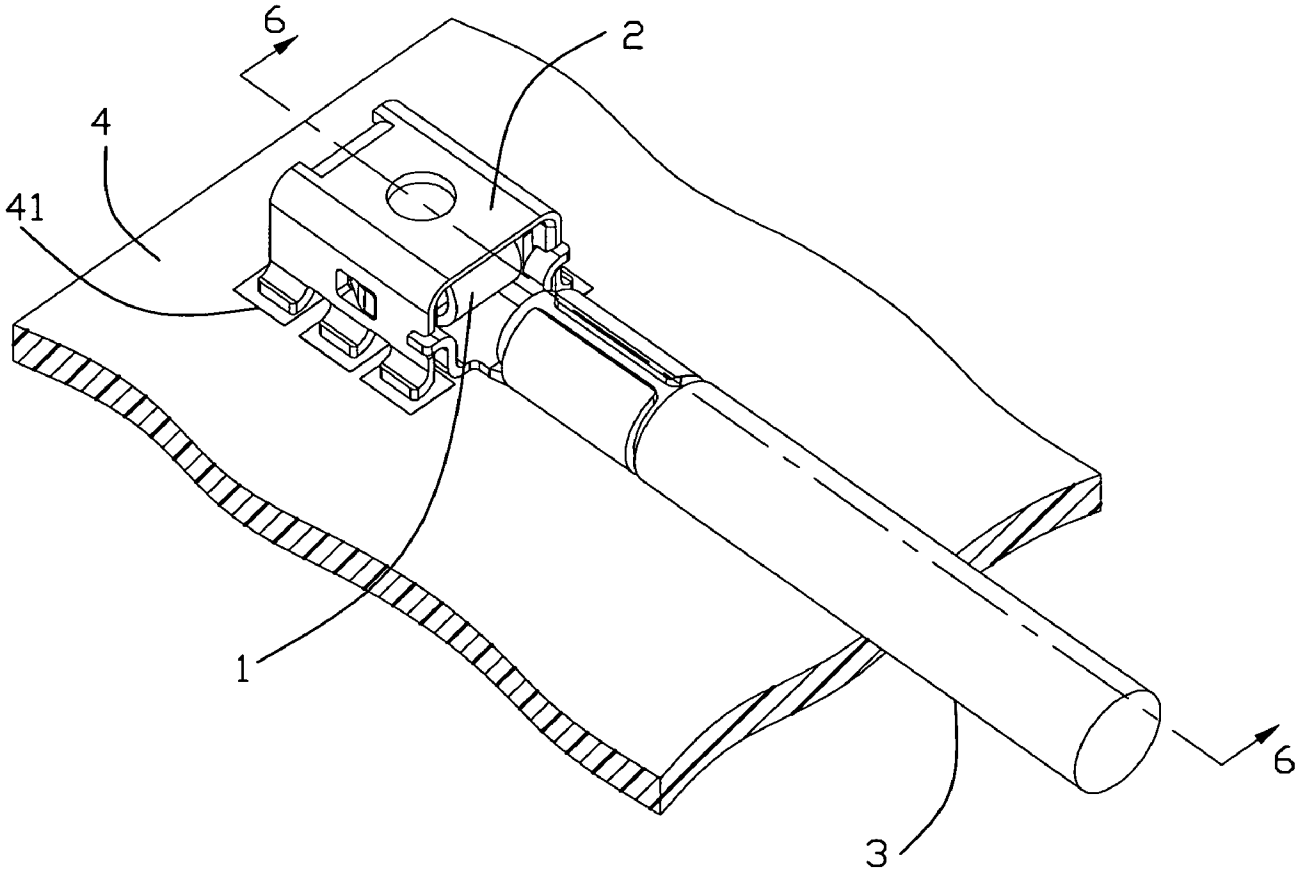
FIG. 5 shows the cable connector assembly assembled to a printed circuit board (PCB) of a solar power control system.

Referring to FIG. 5, the print circuit board (PCB) 4 is illustrated, two rows of conductive pads 41 are respectively formed thereon, and the conductive pads 41 are adapted for soldering the mounting feet 223 of the receptacle member 2 thereon via Surface Mount Technique (SMT). Therefore, the receptacle member 2 can securely mechanically and electrically connecting with the PCB 4. Other components and integrated circuit (IC) of the PCB 4 are omitted.

Referring to FIGS. 3-6, when the plug member 1 mating with the receptacle member 2, firstly, the plug member 1 is inserted into the hollow 211 of the receptacle member 2 along front-to-back direction, with front portion of the first terminal 13 and the pair of transversal sides 12 entering the hollow 211; secondly, the tabs 121 and the planar beam 132 of the first terminal 13 respectively elastically contacting and sliding along inner surfaces of the receptacle member 2; thirdly, the pair of stubs 16 align with and insert into the cutouts 222 as a stopper or positioning member and free ends of the pair of tabs 121 lock into the pair of rectangular locking holes 221 respectively, and the second terminal 14 elastically and electrically contacts with a plated trace 42 of the PCB 4. Thus, the plug member 1 is accommodated in the hollow 211 of the receptacle member 2 in compressed state, so the plug member 1 and the receptacle member 2 keep tensely engagement and the plug member 1 mates with the receptacle member 2 more reliably.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a metallic plug member with a cable connecting thereto, comprising:

a bottom side and a pair transversal sides respectively extending upwardly from transversal edges of the bottom side to form a receiving space, a first terminal disposed in the receiving space, and at least one tab formed on the transversal side; and a metallic receptacle member, comprising:

a planar top wall, a pair of transversal walls bent downwardly from opposite side edges of the top wall to form a hollow receiving the plug member, wherein the transversal wall defines a locking hole latching with the tab of the plug member.

2. The cable connector assembly as claimed in claim 1, wherein the plug member has a second terminal which springs downward and rearward from the bottom side thereof.

3. The cable connector assembly as claimed in claim 1, wherein the plug member has at least one L-shaped stub adjacent to the transversal side and lying at the rear portion of the bottom side thereof.

4. The cable connector assembly as claimed in claim 3, wherein the transversal wall of the receptacle member defines at least one cutout aligning with the L-shaped stub of the plug member.

5. The cable connector assembly as claimed in claim 3, wherein the cutout and the locking hole are aligned with each other and spaced arranged along front-to-back direction.

6. The cable connector assembly as claimed in claim 1, wherein the plug member further comprises a substantially cylindrical-shaped connection portion extending rearward from an rear end of the bottom side and electrically connecting with the cable.

7. The cable connector assembly as claimed in claim 1, wherein the receptacle member has a number of spaced apart mounting feet formed at bottom edge of each transversal wall.

8. The cable connector assembly as claimed in claim 7, wherein the printed circuit board has a plurality of conductive pads arranged in two rows, and wherein the mounting feet of the receptacle member is disposed on the plated pads and soldered thereon via surface mount technique (SMT).

9. A cable connector assembly for forming electrical connection between a cable and a printed circuit board (PCB) comprising:

a metallic plug member;

a metallic receptacle member defining a hollow receiving the plug member; and electricity transmitted to the PCB from the cable via at least two ways:

wherein a first way is the cable, the plug connector, the receptacle connector and the PCB electrically interconnecting together serially;

wherein a second way is the cable, the plug connector and the PCB electrically interconnecting together serially.

10. The cable connector assembly as claimed in claim 9, wherein the receptacle member is a one-piece body which comprises a planar top wall, a pair of transversal walls bent downwardly from opposite side edges of the top wall to form the hollow.

11. The cable connector assembly as claimed in claim 10, wherein the plug member forms a first terminal thereon and the receptacle member defines a number of mounting feet, and wherein the first way includes the first terminal contacting the top wall of the receptacle member and the mounting feet of the receptacle member engaging with the conductive pads of the PCB.

12. The cable connector assembly as claimed in claim 10, wherein the top wall of the receptacle member defines a hole thereon serving as backup for soldering the plug member and the receptacle member.

13. The cable connector assembly as claimed in claim 10, wherein the rear portion of the top wall of the receptacle member further forms a protrusion portion bent downwardly from a rear end thereof.

14. The cable connector assembly as claimed in claim 10, wherein the plug member further defines a second terminal springs downward and rearward from the bottom of the plug member, and wherein the second way includes the second terminal contacting a plated trace formed on the PCB.

15. A cable connector assembly comprising:

a printed circuit board;

a receptacle member mounted on the printed circuit board and including a plurality of walls commonly defining therein a mating port along a front-to-back direction; and a metallic plug member mechanically and electrically assembled to a front end of a cable, said plug member inserted into the mating port, and including a securing section, which is unitarily formed thereon, thus being metallic and conductive, locked to at least one of said walls, and a contacting section mechanically and electrically engaged with a corresponding conductive pad on the printed circuit board for power transmission; wherein said contacting section imposes a downward force upon the conductive pad.

16. The cable connector assembly as claimed in claim 15, wherein said receptacle member defines a U-shaped configuration.

17. The cable connector assembly as claimed in claim 15, wherein said plug member includes a resilient terminal member upwardly engaged with the receptacle member so as to experience a downward reaction force toward the printed circuit board, thus assuring the engagement between the contacting section and conductive pad.

18. The cable connector assembly as claimed in claim 15, wherein said plug member further includes a stub engaged with a corresponding region of the receptacle member for preventing forward movement of the plug member relative to the receptacle member.

19. The cable connector assembly as claimed in claim 15, wherein said receptacle member is metallic, and thus said power transmission additionally occurs from the cable and the plug member through said receptacle member to the printed circuit board.

20. The cable connector assembly as claimed in claim 15, wherein at least one of said plug member and said receptacle member does not have any insulative housing associated therewith but being wholly metallic.

* * * * *